United States Patent [19]

Stragier et al.

[11] 4,005,791

[45] Feb. 1, 1977

[54] REFUSE CONTAINER

[75] Inventors: Marcel G. Stragier; Theodore J. Peterson, both of Scottsdale, Ariz.

[73] Assignee: Government Innovators, Phoenix, Ariz.

[22] Filed: Mar. 17, 1975

[21] Appl. No.: 558,669

[52] U.S. Cl. ..... 214/302; 214/313; 206/517

[51] Int. Cl.[2] ..... B65F 3/02

[58] Field of Search ..... 214/300, 302, 303, 314, 214/313, 147 G; 206/519, 517; 220/263, 264; 294/69, 73

[56] References Cited

UNITED STATES PATENTS

| | | | |
|---|---|---|---|
| 3,666,126 | 5/1972 | Rempel | 214/302 |
| 3,923,174 | 12/1975 | Stragier | 214/313 |

*Attorney, Agent, or Firm*—Knobbe, Martens
*Primary Examiner*—Robert J. Spar
*Assistant Examiner*—Lawrence J. Oresky

[57] ABSTRACT

A refuse container designed for use with a refuse collection system having a dumping arm wherein the configuration of the container allows the grip of the dumping arm to slightly squeeze one portion of the container to maintain a tight grip during the dumping or emptying motion of the container by the arm. Included in the container are strengthening portions which control deflection to produce a gripping cup or restraint in the container when engaged by the dumping arm. The strengthening portions are also designed in one embodiment of the invention to provide additional restraint to compensate for the greater inertia forces experienced on certain portions of the container during the transfer motion of the container by the dumping arm when lifting and dumping the refuse.

8 Claims, 9 Drawing Figures

FIG. 5.
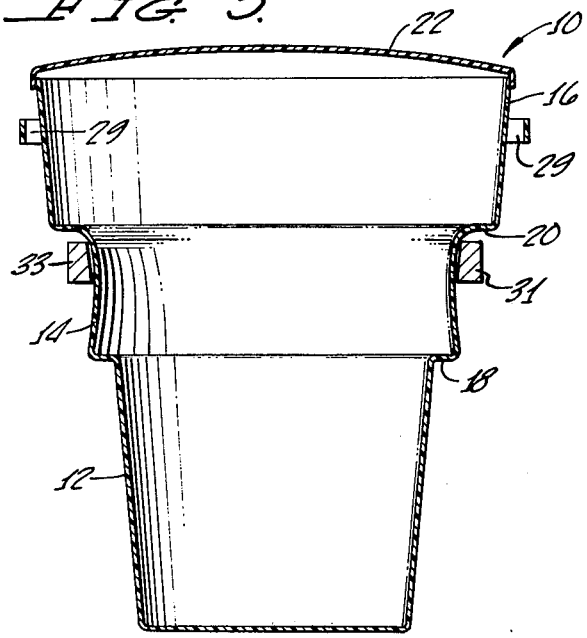
FIG. 6.
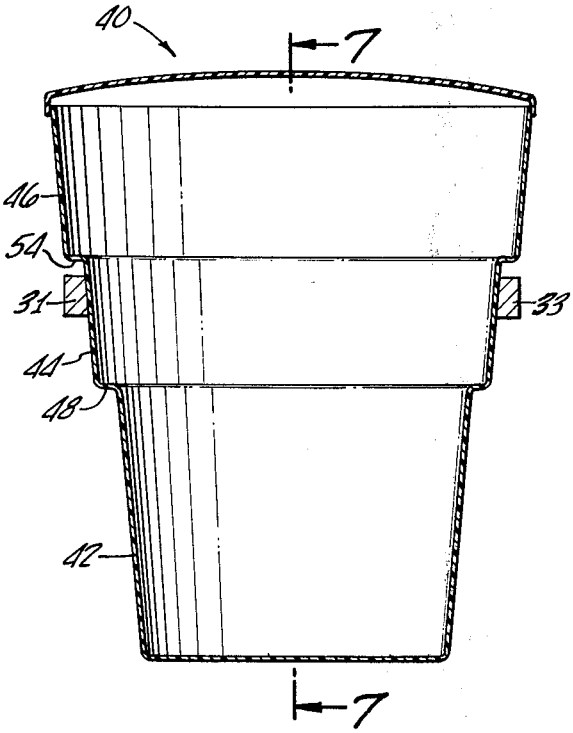
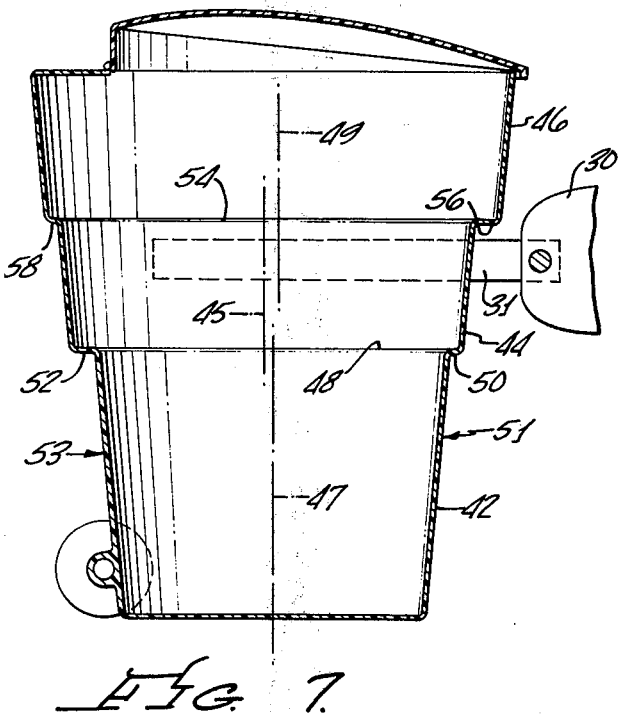
FIG. 7.
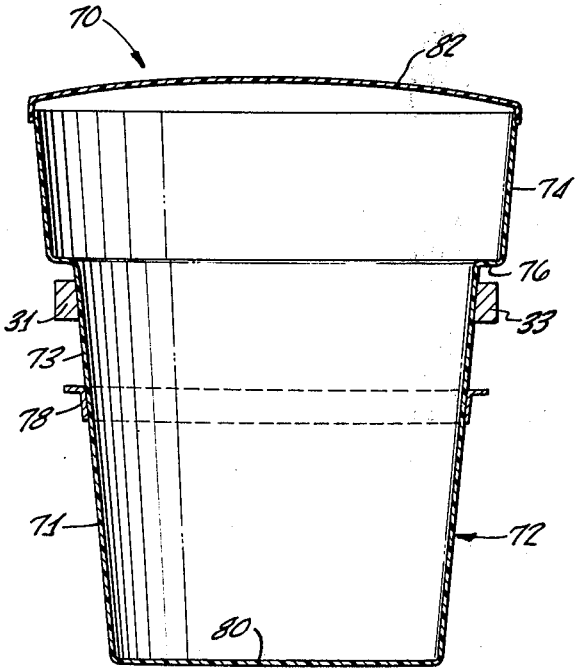
FIG. 8.

REFUSE CONTAINER

BACKGROUND OF THE INVENTION

This invention is related to the field of refuse collection and more specifically is directed to the design of a refuse container for use in conjunction with mechanized collection systems. For example, as shown in more detail in our recent application entitled RAPID RAIL, filed Sept. 13, 1974, Ser. No. 505,765, the driver of a refuse collection truck is able to perform from his position in the cab of the truck the collection function by the use of a mechanized dumping arm which engages refuse containers to lift and invert them over the truck to discharge the refuse into the truck. This invention is a modification of the container disclosed and claimed in U.S. Pat. No. 3,923,174, issued Dec. 2, 1975.

One of the primary difficulties in utilizing a mechanized collection system as discussed above, is maintaining a secure grip or contact between the dumping arm and the container. This difficulty is compounded by the requirement that the container must be tapered, so that it can be removed from the mold and conveniently stacked for shipping and handling. Throughout the normal refuse collection operation, which includes the vertical lifting followed by the inverting of the container to dump the refuse, a secure grip must be maintained to ensure proper and adequate operation of the system, including the prevention of having the container fall into the receiving truck with the refuse. Previous containers utilized a shoulder to ensure that the gripping arm would not slip up over or off the container during the vertical lifting motion. Such a container is shown in our above-referenced RAPID RAIL application. This shoulder is also designed to provide additional strength to the container which is preferably constructed out of a flexible material, allowing the gripping arm to slightly distort the container to maintain its grip. However, when the container is inverted and jerked in order to dump the refuse into the truck, there is a possibility of the container slipping from the grasp of the dumping arm.

SUMMARY OF THE INVENTION

The present invention is directed to a container having means for retaining or preventing the dumping arm from sliding in either direction off of the container during the lifting and inverting phases of the operation without compromising the ability to stack the containers within one another in a nested arrangement for shipping. The invention generally has three portions or sections which are uniquely joined by two generally horizontal shoulders. In the first embodiment the container sections are joined by two concentric shoulders which are integrally connected to the container sections. A second embodiment of the invention connects the container sections with two eccentric shoulders, resulting in the shoulders having a varying depth or width around the circumference of the container. A third embodiment utilizes a generally horizontal shoulder to attach two of the container's sections while a stop guard is used at the junction with the third section of the container.

Having two separated strengthening shoulders, the present invention allows for the dumping arm to grip the middle section or portion of the container and slightly squeeze it to maintain a good grip without deflecting the upper and lower portions of the container, so that the dumping arm will be prevented from slipping off the middle portion onto either the upper or lower portions during the operational phase of the collection process. The eccentric arrangement of the portions of the container in an alternate embodiment of the invention provide additional strength and restraint for the container to withstand the increased stress loads and greater inertia experienced in certain portions of the container during its lifting and inverting phases.

BRIEF DESCRIPTION OF THE DRAWINGS

FIG. 5 is a sectional view taken along the line 5—5 in FIG. 4;

FIG. 6 is a sectional view of a second embodiment of the invention;

FIG. 7 is a sectional view taken along the line 7—7 in FIG. 6;

FIG. 8 is a sectional view of a third embodiment of the invention; and

DETAILED DESCRIPTION OF THE INVENTION

Figure 4:
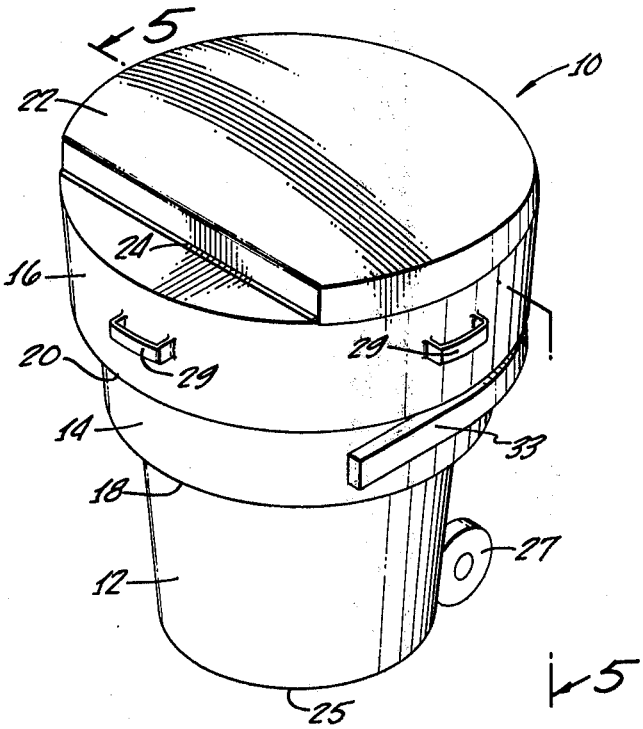
FIG. 4 is a perspective view of the first embodiment of the invention.

The first embodiment 10 of the container invention is shown in FIG. 4 having a lower portion or section 12, a middle portion or section 14, and an upper portion or section 16. The lower portion 12 of the refuse container 10 is normally the largest of the portions and is designed to receive the majority of the refuse. Integrally connecting the middle portion 14 with the lower portion 12 is a generally horizontal shoulder or ridge 18 shown more clearly in FIG. 5. Similarly, the upper portion 16 is connected to the middle portion 14 by a second generally horizontal shoulder or ridge 20. Each of portion 12, 14 and 16 has a general frusto-conical shape which is helpful in the storage of several empty containers, since they can be nested inside each other.

Pivotally connected to the upper portion 16 in FIG. 4 is a lid 22, having a hinge junction 24 upon which it pivots to permit the introduction or exit of refuse. The hinge junction 24 is recessed somewhat toward the center of the container. The lid 22 is somewhat dome-shaped to permit the container to hold a greater amount of refuse. A set of wheels 27 may be connected adjacent the bottom 25 of the container 10 to provide easier movement of the container along the ground for placement adjacent a roadway for refuse pickup. Also, handles 29 are preferably spaced at 90 degrees around the upper section 16.

Figure 1:
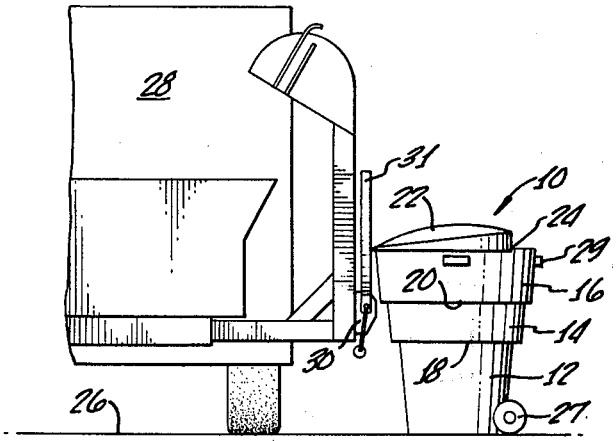
FIG. 1 is an elevation view showing the container adjacent the transfer arm on the refuse vehicle.
Figure 2:
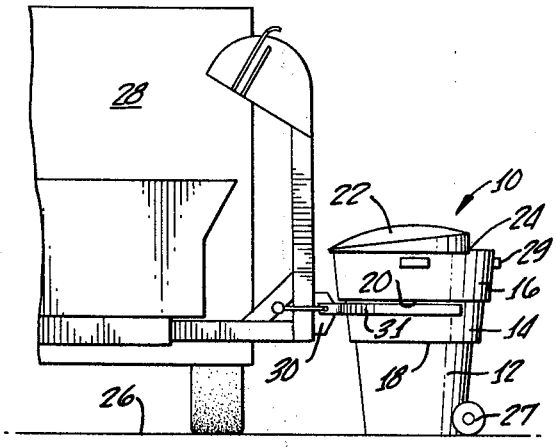
FIG. 2 is a view similar to FIG. 1 showing the engagement of the transfer arm with the container.
Figure 3:
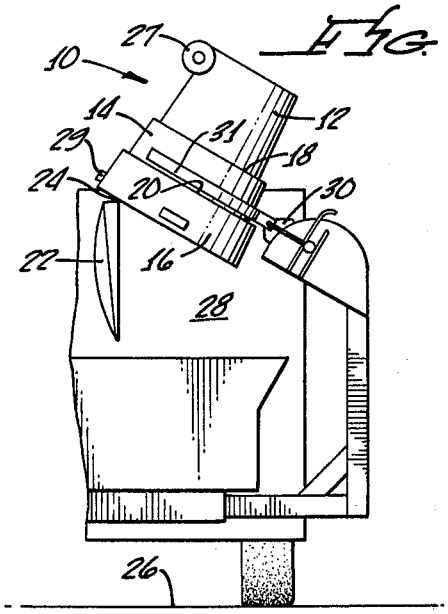
FIG. 3 is a view similar to FIG. 1 showing the container in the inverted position over the refuse truck.

With respect to the utilization of the refuse container 10 reference is made to FIGS. 1 through 3. In a representative situation, the refuse container 10 will be placed on or adjacent the roadway 26, so that the refuse pickup vehicle 28 and its transfer or dumping arm 30 with its two gripping members 31 and 33 (member 33 not shown) can be moved adjacent the container. Once the vehicle is positioned properly adjacent the container 10 as shown in FIG. 2, the gripping members 31 and 33 are positioned on the middle portion 14 of the container. The gripping members will squeeze the container which is preferably made of a flexible material, so that they can maintain a secure grip for the lifting and inverting operations in order to transfer the refuse from the container into the refuse vehicle 28. The squeezing of the gripping members 31 and 33 on the middle section 14 will cause a dimple or concave displacement of the middle section 14 adjacent the area contacted by each of the gripping members 31 and 33. However, the existence of the shoulders 18 and 20 provides strengthening portions to the container, so that the dimple or concave displacement does not extend to the lower portion 12 or the upper portion 16 of the container. Therefore, when the container is lifted and inverted as shown in FIG. 3, the gripping members 31 and 33 will not slip off of the middle portion 14 onto the lower portion 12, because the shoulder 18 provides a rigid area which is not deflected. Reference is made to FIG. 5 showing the dimpling or deflection which occurs on the middle section 14.

A second embodiment 40 of the refuse container is shown in FIGS. 6 and 7, having a lower portion 42, a middle portion 44, and an upper portion 46. Integrally connecting the lower portion 42 with the middle portion 44 is a first shoulder or ridge 48. A second shoulder or ridge 54 connects the upper portion 46 to the middle portion 44. The lower portion 42, the middle portion 44, and the upper portion 46 have a general frusto-conical shape similar to that in the first embodiment 10. As shown in FIG. 7, a pivotal lid 60 is hinged at a junction 62 to allow the automatic opening of the lid 60 when the container 40 is inverted.

The middle portion 44 is offset from the lower portion 42, resulting in the axis 45 of the frusto-conical shaped middle section 44 being eccentric with the axis 47 of the lower portion 42. The eccentricity between the middle portion and lower portion of the container 40 is to provide in FIG. 7 the portion 50 of the shoulder 48 adjacent the front side 51 of the container, where the transfer arm 30 engages the container 40, with a width or depth approximately one-half the portion 52 of the shoulder 48 located 180° away at the rear 53 of the container. The frusto-conical upper portion 46 is offset from the frusto-conical middle portion 44, resulting in the respective axes 49 and 45 of those portions being eccentric. The orientation of the upper portion 46 with the middle portion 44 results in the portion 56 of the shoulder 54 on the front 51 of the container 40 adjacent the transfer arm 30, being about twice the width of the portion 58 of the shoulder 180° away at the rear 53 of the container.

The width of the first shoulder 48 gradually increases from its small width portion 50 at the front 51 of the container to its larger portion 52 at the rear 53 of the container 40. Similarly, the second shoulder 54 has its larger portion 56 gradually tapered to the smaller portion 58. The width of the first shoulder on each side of the container 90° from the rear 53 or front 51 of the container is equal as shown in FIG. 6. Also, the width of the second shoulder 54 is also equal at both sides of the container 90° from either the front 51 or the rear 53 of the container.

In use, the refuse container 40, as shown in FIG. 7, should always be oriented so that the front 51 will be facing the transfer arm 30. This might be accomplished by the placement of a large arrow on the lid 60 of the container to indicate the proper orientation toward the street or the pickup area. The refuse vehicle will drive to a position adjacent the container 40 and engage the transfer arm 30 on the middle portion 44. The transfer arm will grip the preferably slightly flexible container, squeezing the middle portion slightly to deflect the middle portion inward where contacted by the gripping members 31 and 33. The shoulders 48 and 54 will essentially prevent any deflection of the container in the lower portion 42 or the upper portion 46 respectively.

During the lifting process, the gripping members 31 and 33 grasp the container 40 and distort it from a generally circular cross-sectional shape to a generally elliptical cross-sectional shape. The gripping members 31 and 33 extend approximately two-thirds the way around the container and tend to grip the hardest with the extreme ends. Consequently, when the container is raised, the front 51 slips slightly, but the shoulder 56 stops such slipping. When the container 40 is inverted to dump refuse, the back 53 is moving the fastest during the inverting step and experiences the greatest inertia. As a result, the back 53 will tend to slip and without some means to limit the slipping the container could slip out of the gripping members 31 and 33 and fall into the truck. However, the lower shoulder 52 will act as a stop to limit the slipping of the gripping members 31 and 33 and prevent the container 40 from being dropped into the truck.

Referring to FIG. 8, a third embodiment 70 of the refuse container invention is disclosed having a lower body 72 and an upper body or portion 74, each of which have a general frusto-conical shape. At the interface of the lower body 72 with the upper portion 74 is a shoulder or ridge 76. Located on the lower body 72 is a ridge or rib 78 which divides the lower body into a bottom portion 71 and a middle portion 73. The ridge 78 acts as a stop guard to prevent the gripping members 31 and 33 from slipping onto the bottom portion 71 when the container 70 is moved to the inverted position when dumping the refuse into the refuse truck. Since the container 70 is preferably made of a flexible material, the middle portion 73 and the bottom portion 71 will dimple or move inward under the pressure of the transfer arm 30 from an area below the shoulder 76 down toward the bottom 80 of the container with the greatest distortion being at the contact with the gripping members 31 and 33. Pivotally mounted on the upper portion 74 is a lid 82 which is hinged to pivot. The container 70 may be constructed with the ridge 78 extending only along a portion of the sides of the container rather than completely around the container. In other words, there may be two separate sections of the ridge 78 and located on each side of the container to act as stop guards for preventing slippage of the gripping members 31 and 33 onto the bottom portion 71.

Figure 9:
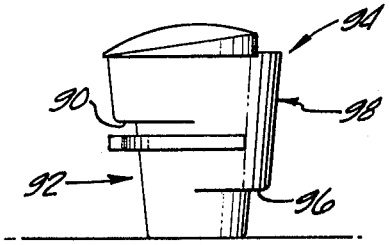
FIG. 9 is a sectional view of a fourth embodiment of the invention

In the use of the container 70, the transfer arm grasps the middle portion 73 of the container between the shoulder 76 and the ridge or stop guard 78. The shoulder 76 ensures that the transfer arm 30 does not slip onto the upper portion 74 and possibly off the container during the lifting mode of operation. The stop guard 78 prevents the transfer arm 30 from slipping onto the bottom portion 71 of the container when it is in the inverted mode of operation. It may also be desirable to have eccentric or concentric shoulders which do not extend completely around the container, but rather taper smoothly into the side of the container at for example approximately 180°. In other words, as shown in FIG. 9, an upper shoulder 90 might be formed on the front side 92 of the container 94 and a lower shoulder 96 on the rear side 98 with neither extending completely around the container. As a result, the functions of preventing the slippage of the container during both the lifting and inverting stages are respectively accomplished by the two shoulders 90 and 96. Furthermore, this design will tend to allow for more space in the container for receipt of refuse than when the shoulders extend completely around the container.

What is claimed is:

1. A flexible refuse container in combination with a refuse collection vehicle having an arm movable from a lowered position to a raised position for engaging, lifting, and inverting the container to dump its contents into the vehicle, said container comprising:

a lower body section of inverted truncated conical configuration;

an upper body section connected to said lower body section;

a pair of ridges located adjacent the connection of said lower and upper body sections and spaced apart vertically by a distance at least twice the vertical dimension of the arm; and said arm engaging and flexing inwardly said container between said spaced ridges to prevent said arm from slipping onto either of said upper and lower body sections during said lifting and inverting operations.

2. A flexible refuse container in combination with a refuse collection vehicle having an arm movable from a lowered position to a raised position for engaging, lifting, and inverting the container to dump its contents into the vehicle, said container comprising:

a lower portion;

a middle portion adapted to flex when squeezed by the arm of a refuse collection mechanism;

a first shoulder integrally connecting said lower portion to said middle portion, said first shoulder being larger at the interface of one side of said lower and middle portions than at the interface of the opposite side of said lower and middle portions;

an upper portion; and a second shoulder integrally connecting said middle portion to said upper portion, said second shoulder being larger at the interface of said opposite side of said middle and upper portions than at the interface of said one side of said middle and upper portions.

3. A refuse container for use with a refuse collection mechanism having a transfer arm, said container comprising:

a lower portion;

a middle portion;

a generally horizontal first shoulder integrally connecting said middle portion to said lower portion;

an upper portion; and a generally horizontal second shoulder integrally connecting said upper portion to said middle portion, said arm contacting said container around said middle portion, said container being flexible, so that said middle portion is flexed in a concave orientation inward toward the center of said container by said arm, said first and second shoulders being stiff in order to prevent said arm from slipping onto either of said lower and upper portions during operation of said refuse collection mechanism.

4. A refuse container for use with a refuse collection vehicle having a dumping arm, said container comprising:

a first section having a circular cross-section;

a second section having a circular cross-section and connected to said first section, the largest diameter of said first section being smaller than the smallest diameter of said second section; and means for connecting said first section with said second section, said connecting means receiving said arm;

means adjacent the interface of said connecting means with said first section for preventing said arm from slipping onto said first section during a dumping operation of said container; and means adjacent the interface of said connecting means with said second for preventing said arm from slipping onto said second section during a lifting operation of said container.

5. A flexible refuse container in combination with a refuse collection vehicle having an arm movable from a lowered position to a raised position for engaging, lifting, and inverting the container to dump its contents into the vehicle, said container comprising:

a bottom;

a lower side wall portion connected to said bottom containing refuse;

a flexible middle side wall portion connected on the upper end of said lower portion;

a first generally horizontal shoulder integrally connecting said lower and middle portion;

an upper side wall portion attached to the upper end of said middle portion; and a second generally horizontal shoulder integrally connecting said middle and upper portions, said middle portion receiving said arm, said first and second shoulder preventing deflection in said lower and upper portions when said arm engages said middle portion during operation of said system.

6. A refuse container as defined in claim 5 and additionally comprising a lid hinged to said upper portion and adapted to automatically open when said container is inverted.

7. In combination with a refuse collection mechanism having a transfer arm which is adapted to grip and squeeze a refuse container, a refuse container comprising:

a bottom and sidewall means for containing refuse;

at least a portion of said sidewall means being flexible and adapted to flex to a concave configuration when squeezed by said arm to improve the grip of the arm on the container;

first means on said sidewall means for confining the flexure in one direction when squeezed by the arm;

second means on said sidewall defining a limit to slippage of said arm in the direction opposite to said one direction when said sidewall is squeezed by said arm and flexed; and said first and second means being disposed on opposite sides of said arm and spaced by a distance substantially less than the height of the container.

8. The combination as defined in claim 7 and further comprising:

both said first and second means being shoulders formed integrally with said sidewall means to rigidify the container and confine the flexure to the area near the arm.

* * * * *